US007824178B1

(12) United States Patent
Putnam et al.

(10) Patent No.: US 7,824,178 B1
(45) Date of Patent: Nov. 2, 2010

(54) AIR TRANSFER ARM FOR BOILER

(75) Inventors: Benjamin P. Putnam, Watertown, TN (US); Dustin C. Wiggins, Old Hickory, TN (US)

(73) Assignee: Lochinvar Corporation, Lebanon, TN (US)

( * ) Notice: Subject to any disclaimer, the term of this patent is extended or adjusted under 35 U.S.C. 154(b) by 330 days.

(21) Appl. No.: 12/029,737

(22) Filed: Feb. 12, 2008

(51) Int. Cl.
*F23D 14/36* (2006.01)
*F24H 1/11* (2006.01)

(52) U.S. Cl. ..... 431/159; 431/7; 431/329; 126/512; 126/350.1; 126/116 R; 126/110 D; 126/110 R; 122/14.2; 122/32; 122/14.22; 122/134

(58) Field of Classification Search ..... 431/159, 431/329; 122/32, 181, 14.2, 14.22, 17.1; 126/512, 350.1, 110 R, 110 D
See application file for complete search history.

(56) References Cited

U.S. PATENT DOCUMENTS

| | | | | | |
|---|---|---|---|---|---|
| 2,433,317 | A | * | 12/1947 | Carter | 431/265 |
| 2,581,316 | A | * | 1/1952 | Wolfersperger | 122/134 |
| 2,638,745 | A | * | 5/1953 | Nathan | 60/748 |
| 3,227,202 | A | * | 1/1966 | Morgan | 431/353 |
| 3,808,987 | A | * | 5/1974 | Ehrlichmann | 110/212 |
| 3,918,885 | A | * | 11/1975 | Palm et al. | 431/182 |
| 4,222,671 | A | * | 9/1980 | Gilmore | 366/337 |
| 4,723,513 | A | | 2/1988 | Vallett et al. | 122/19 |
| 4,793,800 | A | | 12/1988 | Vallett et al. | 431/328 |
| 5,989,020 | A | | 11/1999 | Glass et al. | 432/161 |
| 6,428,312 | B1 | | 8/2002 | Smelcer et al. | 431/329 |
| 6,619,951 | B2 | | 9/2003 | Bodnar et al. | 431/329 |
| 6,694,926 | B2 | | 2/2004 | Baese et al. | 122/14.2 |
| 7,267,083 | B2 | | 9/2007 | Le Mer et al. | 122/32 |
| 2005/0178344 | A1 | * | 8/2005 | Garrett et al. | 122/17.1 |

FOREIGN PATENT DOCUMENTS

DE EP1443270 A1 * 1/2003

OTHER PUBLICATIONS

EIC technical search report.*

Exhibit A: "Inside the KNIGHT" four page brochure for the Lochinvar Corporation KNIGHT™ boiler. (undated but admitted to be prior art).

Exhibit B: Two page printout from the website of Giannoni France, illustrating their heat exchangers corresponding generally to U.S. Patent 7,267,083 to Le Mer et al. (undated but admitted to be prior art).

Exhibit C: Two page printout from the website of Remeha.info showing the Remeha Gas model 210ECO-3 condenser boiler. (undated but admitted to be prior art).

Exhibit D: Two page printout from the website of Remeha.info showing the Remeha Gas model 310ECO-5 condensing boiler. (undated but admitted to be prior art).

(Continued)

*Primary Examiner*—Steven B McAllister
*Assistant Examiner*—Nikhil Mashruwala
(74) *Attorney, Agent, or Firm*—Waddey & Patterson, P.C.; Lucian Wayne Beavers

(57) ABSTRACT

A water heater apparatus includes a fuel-air transfer arm connecting a blower outlet to a burner inlet. The transfer arm includes a continuously curved 180° bend portion and at least one inwardly extending internal flow disrupter located in the 180° bend portion for improving fuel-air mixture distribution across the burner inlet.

7 Claims, 7 Drawing Sheets

OTHER PUBLICATIONS

Exhibit E: Two page printout from the website of Remeha.info showing the Remeha Gas model 610ECO-6 condensing boiler. (undated but admitted to be prior art).

Exhibit F: One page drawing of a Giannoni conical shaped transistion for a front mount blower. (admitted to be prior art).

* cited by examiner

AIR TRANSFER ARM FOR BOILER

BACKGROUND OF THE INVENTION

1. Field of the Invention

The present invention relates generally to boilers or heaters for heating water, and more particularly to a transfer arm for transferring a fuel-air mixture from a blower to a burner inlet of the water heater.

2. Description of the Prior Art

One prior art water heater system which has been marketed by Lochinvar Corporation, the assignee of the present invention, is that sold as its KNIGHT™ heating boiler models KBN399 and KBN500. The KNIGHT™ heating boiler is a high efficiency condensing boiler. It utilizes a heat exchanger design marketed by the Giannoni Company of France, and constructed generally in accordance with the teachings of U.S. Pat. No. 7,267,083 to LeMer et al., the details of which are incorporated herein by reference.

The Lochinvar KNIGHT™ heating boiler has a horizontally oriented cylindrical combustion chamber defined within a primary heat exchanger. The primary heat exchanger is located in parallel above a secondary horizontally oriented heat exchanger. An elongated burner tube extends axially into the combustion chamber. A variable speed pre-mix blower is located above the combustion chamber for providing a fuel-air mixture to the burner at variable flow rates. A fuel-air transfer arm connects a blower outlet to an inlet of the burner. This prior art fuel-air transfer arm is shown in FIGS. 11-15, and is designated by the numeral 100. The fuel-air transfer arm 100 takes the fuel-air mixture supplied from the blower, turns it through a first sharp 90° turn 102, ducts it to a position adjacent the burner inlet, and turns the fuel-air mixture through a second sharp 90° turn 104 to direct it to the burner inlet.

The design of the KNIGHT™ boiler described above has been successfully utilized for boilers up to 500,000 BTU/hr output. We have discovered that when the general design of the KNIGHT™ boiler is scaled up to provide boiler outputs in excess of about 500,000 BTU/hr, problems are encountered in the flow of the fuel-air mixture to the burner, and the present invention is directed to the solution of those problems.

SUMMARY OF THE INVENTION

A water heater apparatus includes a horizontally oriented cylindrical combustion chamber, and an elongated burner tube extending axially in a first direction into the combustion chamber. The burner tube has a burner inlet. A variable speed pre-mix blower is located above the combustion chamber for providing a fuel-air mixture to the burner at variable flow rates. The blower has a blower outlet. A fuel-air transfer arm connects the blower outlet to the burner inlet. The transfer arm includes a continuously curved 180° bend portion and at least one inwardly extending internal flow disrupter located in the 180° bend portion for improving fuel-air mixture distribution across the burner inlet.

The fuel-air transfer arm may also be referred to as a transfer arm apparatus for transferring fuel-air mixture from a blower to a water heater. The transfer arm apparatus includes a rectangular inlet facing in a first direction and having an inlet axis. The transfer arm apparatus includes a circular outlet having an outlet axis parallel to the inlet axis. The outlet faces in the same direction as the inlet. A tubular body extends from the rectangular inlet to the circular outlet. The body includes a continuously curved 180° bend portion and has a cross-sectional shape that transitions from rectangular adjacent the rectangular inlet to circular adjacent the circular outlet. At least one inwardly extending internal flow disrupter is located in an outside curve of the 180° bend portion of the body for disrupting a concentration of flowing fuel-air mixture to the outside curve that would otherwise occur due to centrifugal force on the mixture as the mixture flows through the 180° bend portion.

Accordingly, it is an object of the present invention to provide a water heater having improved fuel-air mixture distribution across a burner inlet of the water heater.

Another object of the present invention is the provision of a transfer arm apparatus for transferring fuel-air mixture from a blower to a water heater.

And another object of the present invention is the provision of a transfer arm apparatus having one or more internal flow disrupters for improving the cross-sectional distribution of fuel-air mixture across the cross-section of the transfer arm apparatus.

Still another object of the present invention is the provision of a blower construction allowing for compact packaging of the water heater within its housing.

Other and further objects features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
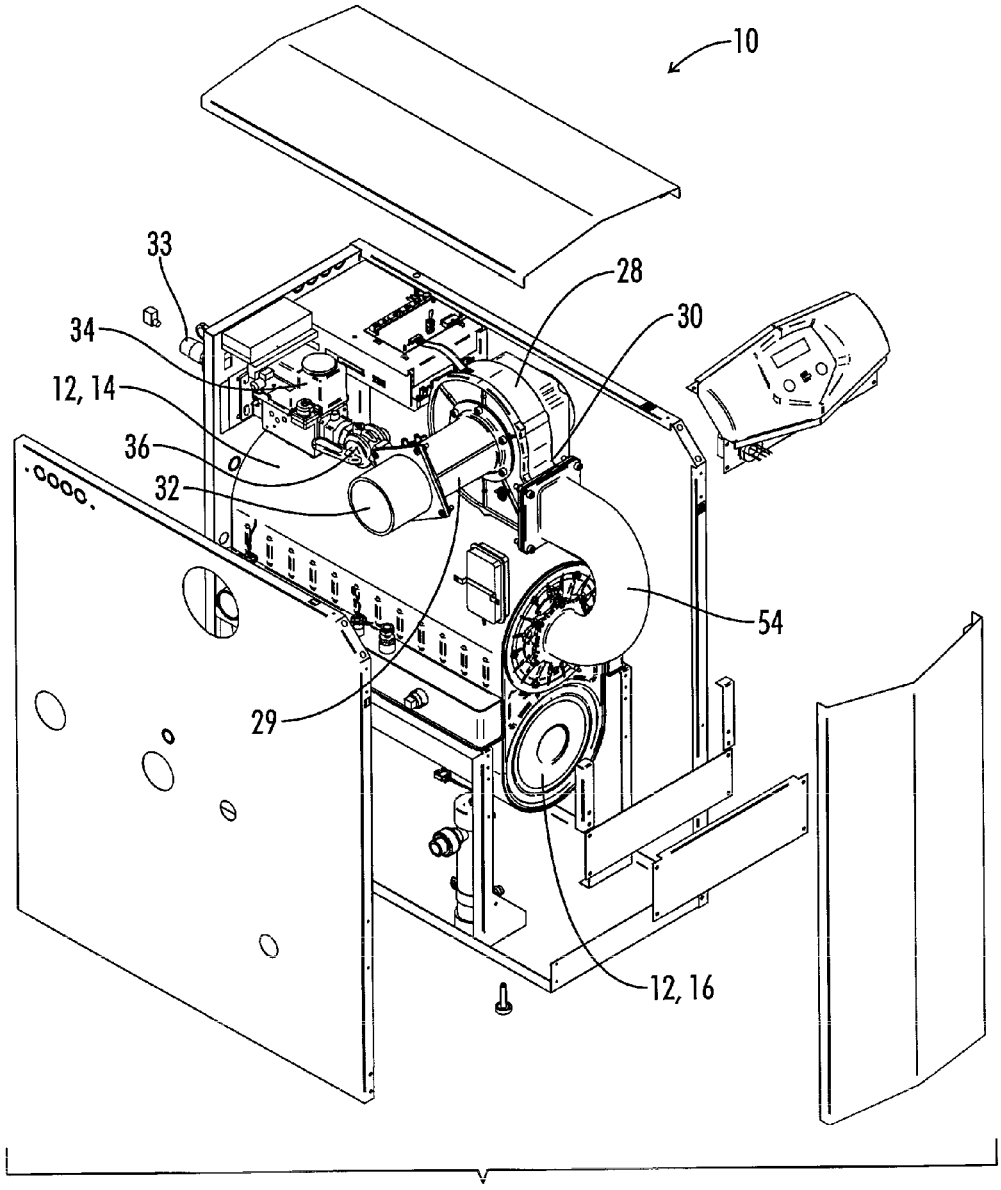
FIG. 1 is a perspective view of a water heater having external housing panels shown in exploded form so that the internal water heater assembly is visible.

Referring now to the drawings, and particularly to FIG. 1, the water heater or boiler apparatus of the present invention is shown and generally designated by the numeral 10. As used herein, the term "water heater" refers to an apparatus for heating water, including both steam boilers and water heaters that do not actually "boil" the water. This discussion sometimes refers to the apparatus 10 as a boiler 10, but it will be understood that this description is equally applicable to water heaters that do not boil the water. The boiler 10 includes a heat exchanger unit 12 having an upper primary heat exchanger 14 and a lower secondary heat exchanger 16.

Figure 2:
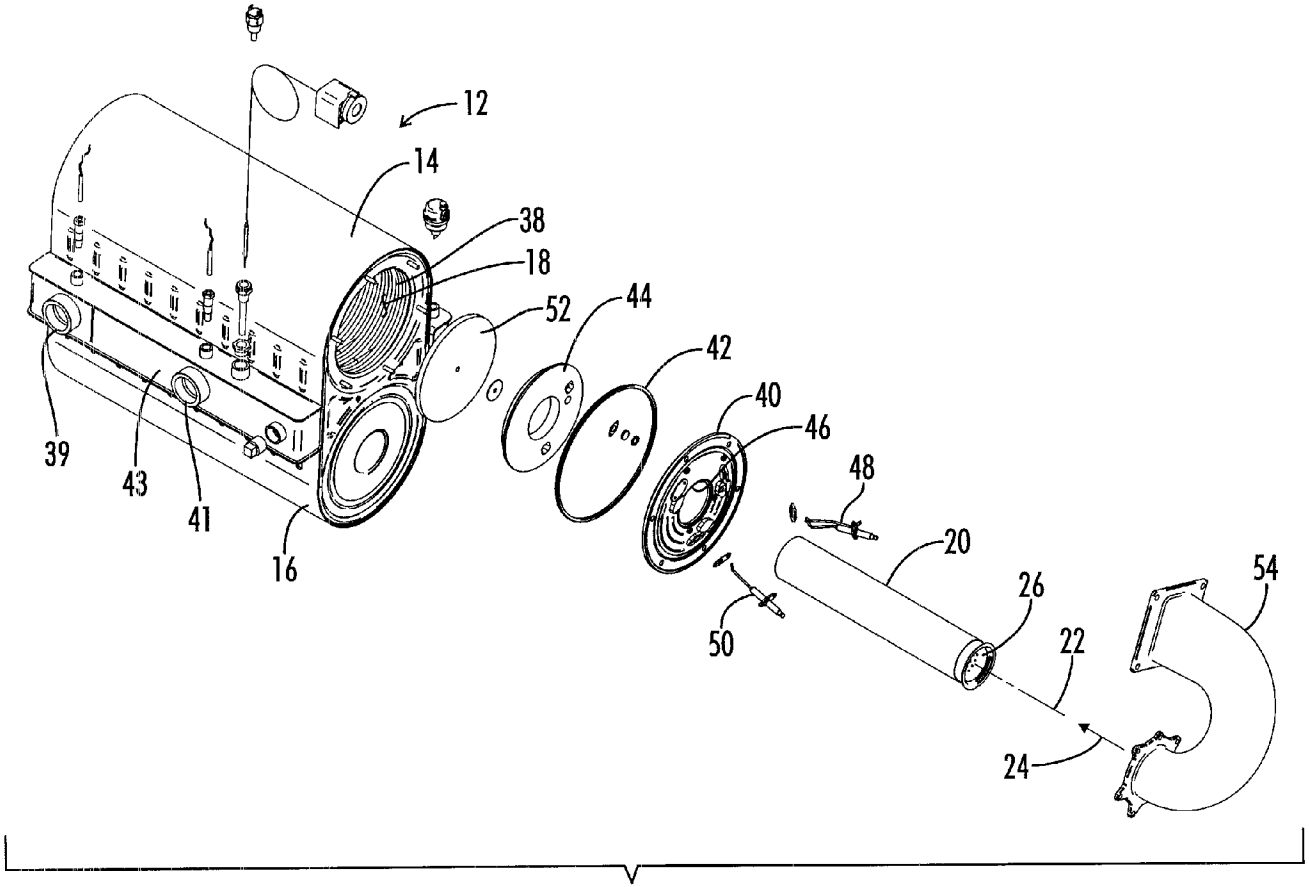
FIG. 2 is an exploded view of the heat exchanger, burner tube, and the fuel-air transfer arm of the water heater of FIG. 1.

As best seen in the exploded view of FIG. 2, a horizontally oriented cylindrical combustion chamber 18 is defined within the upper primary heat exchanger 14. An elongated burner tube 20 has a longitudinal axis 22, and the burner tube extends axially in a first direction 24 into the combustion chamber 18. The burner tube 20 has a burner inlet 26 at one end thereof.

As seen in FIG. 1, a variable speed pre-mix blower or blower assembly 28 is located above the combustion chamber 18 for providing a fuel-air mixture to the burner 20 at variable flow rates. The blower 28 has a blower outlet 30. The blower 28 may for example be a model G1G170 blower manufactured by EBM Papst, Inc. of Farmingtion, Conn.

The burner tube 20 extends internally of the primary heat exchanger 14 along substantially its entire length. The burner 20 is of the type referred to as a pre-mix burner which burns a previously mixed mixture of combustion air and gas. The burner 20 is a single stainless steel assembly covered with woven steel mesh and fires in a 360° pattern along the entire length of the primary heat exchanger. The burner tube 20 may be constructed in any suitable manner including that disclosed in Baese et al. U.S. Pat. No. 6,694,926 or in U.S. Pat. No. 6,619,951 to Bodnar et al. or U.S. Pat. No. 6,428,312 to Smelcer et al., all of which are incorporated herein by reference.

In the system shown in FIG. 1, a venturi 29 is provided for mixing combustion air and fuel gas. The venturi 29 may, for example, be a model VMU300A1046 provided by Honeywell, Inc. An air supply duct 32 provides combustion air to the venturi 29. A gas supply line 33 provides fuel gas to the venturi 29 through a gas control valve 34 and a gas cut-off valve 36. The gas control valve 34 regulates the amount of gas entering the venturi 29.

In order to provide the variable output operation of the burner 20 the variable flow blower 28 delivers the pre-mixed combustion air and fuel gas to the burner 20 at a controlled blower flow rate within a blower flow rate range. The blower 28 includes a variable frequency drive motor which controls the flow rate of the blower.

The gas supply line 33 will be connected to a conventional fuel gas supply (not shown) such as a municipal gas line or a propane storage tank, with appropriate pressure regulators and the like being utilized to control the pressure of the gas supply to the venturi 29.

The gas control valve 34 is preferably a ratio gas valve for providing fuel gas to the venturi 29 at a variable gas rate which is proportional to the flow rate entering the venturi 29, in order to maintain a predetermined air to fuel ratio over the flow rate range in which the blower 28 operates.

The burner tube 20 is concentrically received within a helically wound stainless steel heat exchanger tube 38 of the primary heat exchanger 14. Hot combustion gases from the burner 20 pass through spaces between the coils of the heat exchanger tube 38 so that combustion heat is transferred to water flowing through the heat exchanger tube 38. The combustion gases then pass downward and radially inward through a second coil heat exchanger tube (not shown) of the secondary heat exchanger 16, and then the spent combustion gases exit through a flue gas exit (not shown) on the back side of the secondary heat exchanger 16. Water is directed to and from the helical tubes of the heat exchangers 14 and 16 via inlet 39 and outlet 41 of a water header 43.

FIG. 2 illustrates in an exploded manner the way in which the burner tube 20 is mounted within the primary heat exchanger 14.

A heat exchanger access door 40 mounts on the heat exchanger assembly 12 with the aid of a gasket 42 and insulation disc 44. The burner tube 20 is inserted through an inlet opening 46 of the heat exchanger access door 40.

An igniter 48 mounts in the heat exchanger access door 40 for igniting the fuel-air mixture. A flame sensor 50 mounts within the heat exchanger access door 40 for sensing and confirming the ignition of the fuel-air mixture.

An insulation baffle 52 is inserted in the combustion chamber 18 and is located at the rear end thereof.

The fuel-air mixture is conveyed from the blower 28 to the burner 20 by means of a fuel-air transfer arm 54 which connects the blower outlet 30 to the burner inlet 26. The details of construction of the transfer arm 54 are seen in FIGS. 4-9.

The transfer arm 54 includes a rectangular inlet 56 which faces toward the blower 28 which may be described as facing in the first direction 24 (see FIG. 2). The inlet 56 has an inlet axis 58.

Transfer arm 54 has a circular outlet 60 having an outlet axis 62 parallel to the inlet axis 58 and facing in the same direction 24 as the inlet 56.

A tubular body 64 of the transfer arm 54 extends from the rectangular inlet 56 to the circular outlet 60. The tubular body 64 includes a continuously curved 180° bend portion 66, which may also be referred to as a generally U-shaped bend portion 66. It will be appreciated that the bend portion 66 encompasses approximately 180° so that the inlet 56 and outlet 60 may both face in generally the same direction. The body 64 has a cross-sectional shape that transitions from rectangular adjacent the rectangular inlet 56 to circular adjacent the circular outlet 60, as seen in the series of cross-sectional views 9A-9E.

Figure 7:
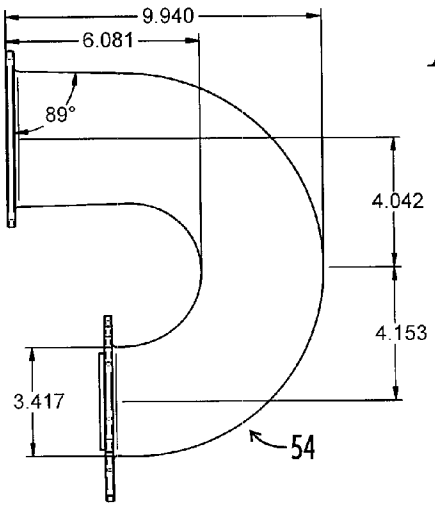
FIG. 7 is a side elevation view of the transfer arm of FIG. 4.
Figure 5:
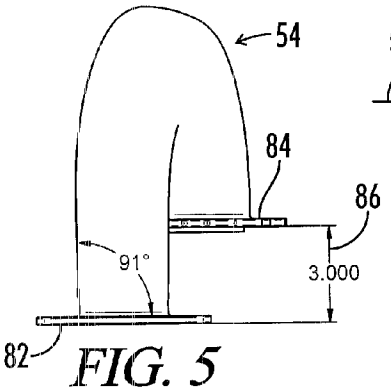
FIG. 5 is a plan view of the transfer arm of FIG. 4.
Figure 6:
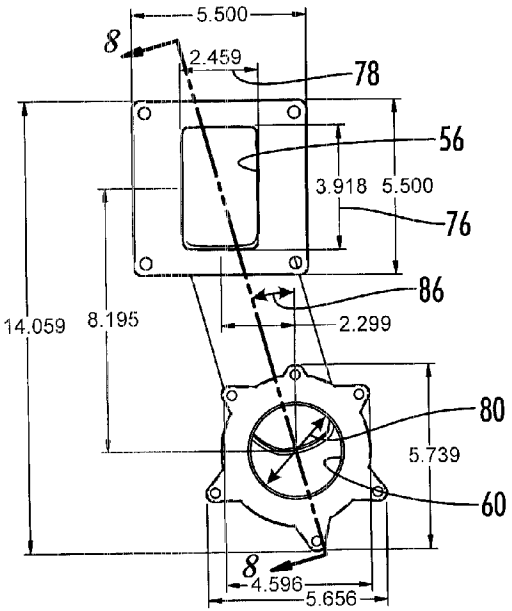
FIG. 6 is a rear elevation view of the transfer arm of FIG. 4.
Figure 9A:
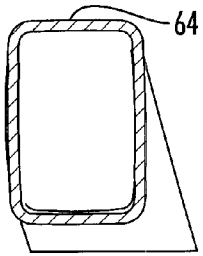
FIGS. 9A-9E are a series of cross-sectional views of the transfer arm taken along lines 9A-9A through 9E-9E of FIG. 9.
Figure 9B:
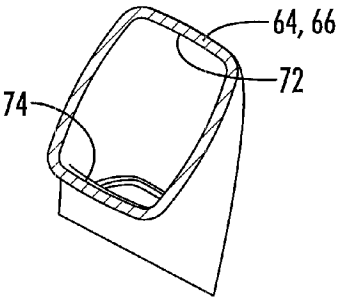
Figure 9C:
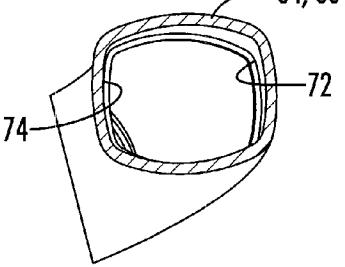
Figure 9D:
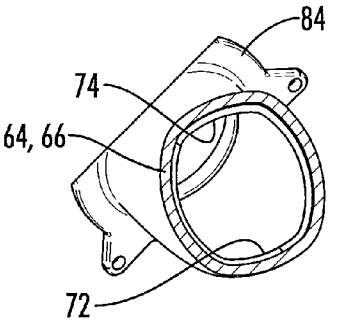
Figure 9E:
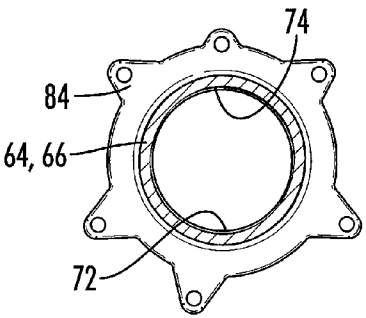
Figure 9:
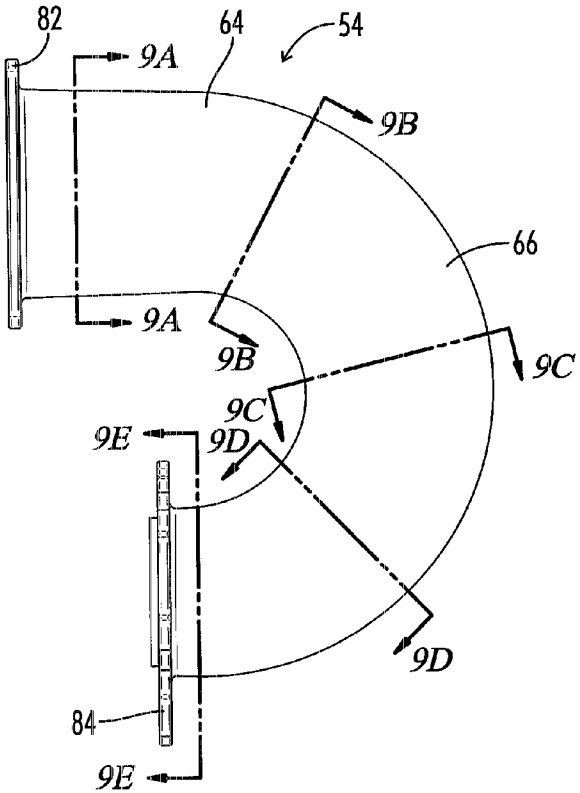
FIG. 9 is a side elevation view similar to FIG. 7, and showing the location of the cross-sectional views of FIGS. 9A-9E.

In FIGS. 5-7 the specific dimensions for one embodiment of the transfer arm 54 designed for use in a boiler 10 having a capacity in the range of from 500,000-800,000 BTU/hr are given. The dimensions shown in FIGS. 5-7 are in inches.

The use of the transfer arm 54 having the continuously curved 180° bend portion 66 provides a means for reversing the direction of the fuel-air mixture exiting the outlet 30 of blower 28 and conducting that mixture to the burner inlet 26 while providing a relatively uniform distribution of that fuel-air mixture across the cross-section of the burner inlet 26.

Figure 8:
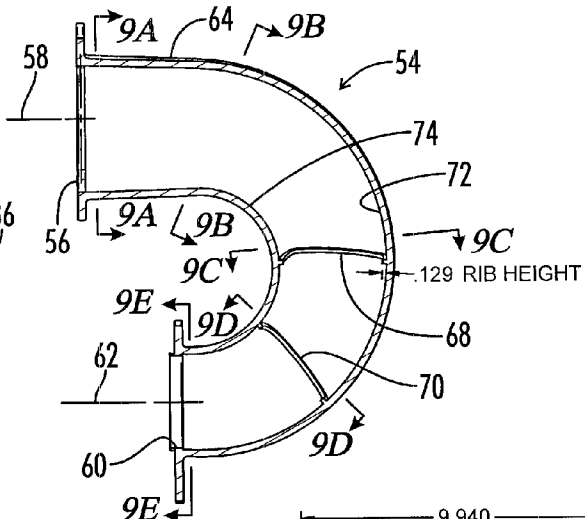
FIG. 8 is a cross-sectional view of the transfer arm of FIG. 4 taken along line 8-8 of FIG. 6.

That distribution can be further improved by the addition of one or more inwardly extending internal flow disrupters such as 68 and 70, as seen in FIG. 8.

The 180° bend portion 66 of the tubular body 64, as best seen in the cross-section of FIG. 8, can be described as having an outside curve 72 and an inside curve 74 of the tubular body 64. By outside curve 72 it is meant that when considering the flow of fluid from inlet 56 to outlet 60 as that fluid passes around the curve of the 180° bend portion 66 the outside portion 72 of the curve is like the outside of a bend of a river. Both the outside of the curve 72 and the inside of the curve 74 are internal to the tubular body 64.

Although there are several phenomena that affect the uniformity of distribution of the fuel-air mixture as it enters the burner inlet 26, one such phenomenon is that the rapidly flowing fuel-air mixture tends to concentrate at the outside curve 72 due to centrifugal force as the mixture flows around the 180° bend portion 66.

Figure 10:
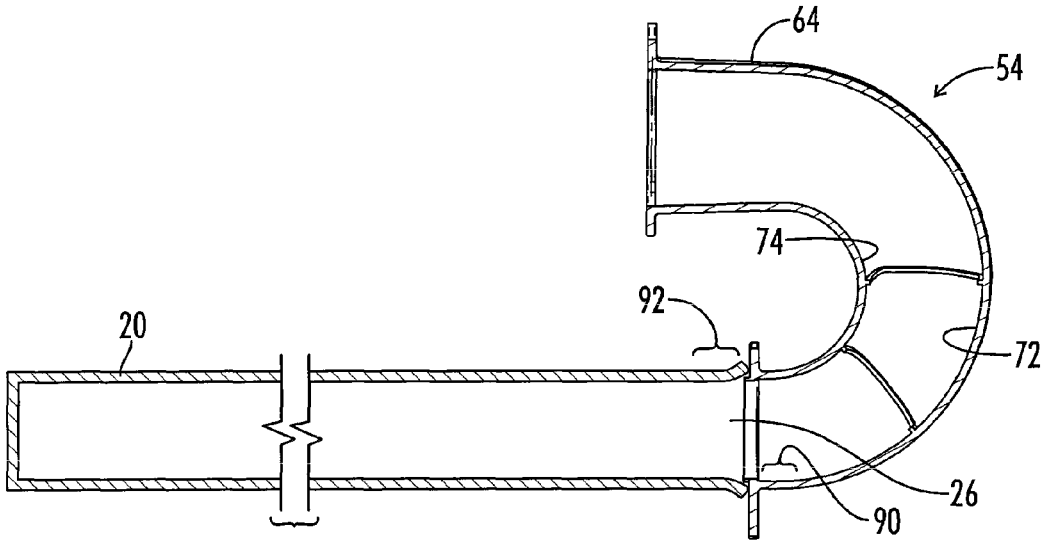
FIG. 10 is a cross-sectional view of the transfer arm similar to FIG. 8 shown in assembly with the burner tube so as to illustrate the location of various problem areas in flow distribution in the assembly.
Figure 12:
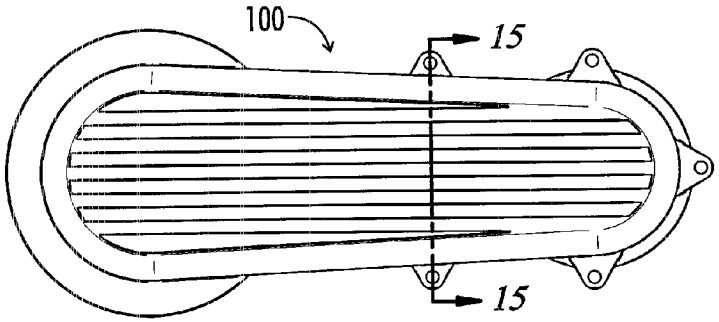
FIG. 12 (PRIOR ART)
FIG. 12 is a front view of the prior art transfer arm of FIG. 11.
Figure 14:
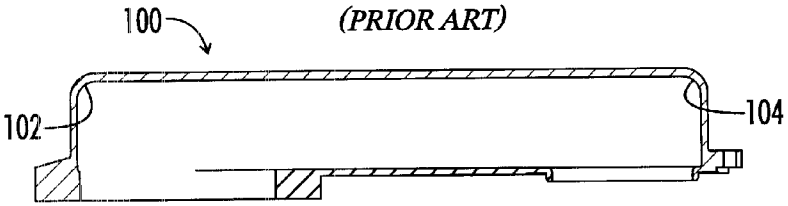
FIG. 14 (PRIOR ART)
FIG. 14. is a lengthwise cross-sectional view of the prior art transfer arm of FIG. 11, taken along line 14-14 of FIG. 13.
Figure 13:
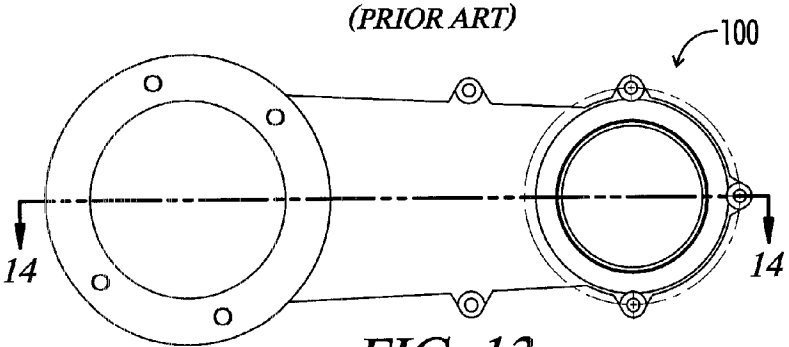
FIG. 13 (PRIOR ART)
FIG. 13 is a rear view of the prior art transfer arm of FIG. 11.
Figure 15:
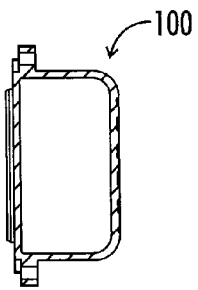
FIG. 15 (PRIOR ART)
FIG. 15 is a widthwise cross-sectional view of the prior art transfer arm of FIG. 11, taken along line 15-15 of FIG. 12.
Figure 11:
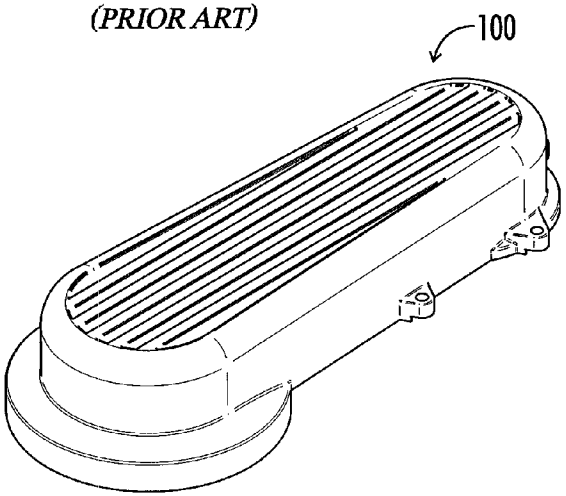
FIG. 11 (PRIOR ART)
FIG. 11 is a perspective view of the prior art transfer arm of the Lochinvar Corporation KNIGHT™ water heater.

Such a concentration at the outside curve 72 adjacent the burner inlet 26, such as at location 90 indicated on FIG. 10, creates a negative pressure location diametrically opposed thereto, such as at location 92 indicated on FIG. 10, thus creating a hot spot on the burner tube 20 at location 92 which can create flashback, i.e. combustion of the fuel-air mixture in the transfer arm 54 or outside of the combustion chamber 18. Such flashback problems can occur with both natural gas and with propane, but they tend to occur even more when using propane. Preferably the transfer arm 54 and other components of the boiler 10 are designed such that As contrasted to a prior art system like that of the Lochinvar Corp. KNIGHT™ boiler having a transfer arm 100 with two sharp 90° bends 102 and 104 as shown in FIGS. 11-15, the transfer arm 54 of the present invention provides a greatly improved distribution of the fuel-air mixture across the cross-section of the burner inlet 26. This improved cross-sectional distribution is due in a first part to the provision of the transfer arm 54 having the tubular body 64 which smoothly transitions from the rectangular inlet 56 to the circular outlet 60 through the 180° bend portion as seen in FIGS. 9A-9E, and in a second part due to the presence of the internal flow disrupters 68 and 70 which increase turbulence of the mixture flowing through the transfer arm 54.

It will be appreciated that this problem is most severe when the water heater 10 is operated at or near its maximum capacity thus having the highest fluid flow rates through the transfer arm 54. Since the water heater 10 is a modulating water heater, and preferably has a turn down ratio of at least 5:1, it will be understood that when the water heater 10 is operating at the low end of its operating range, the problem of uneven flow distribution due to centrifugal forces acting on rapidly flowing gases will be less severe.

The flow disrupters 68 and 70 illustrated in FIG. 8 are both shown as annular ribs 68 and 70 which extend peripherally around the entire inside cross-section of the tubular body portion 64. More generally, however, the flow disrupters 68 and 70 only need to be located on the outer curve portion 72 and could, for example, be semi-circular ribs which could be described as extending peripherally around at least one half of an inside cross-section of the body 64. Even more generally, the flow disrupters could encompass less than one half of the inside cross-section of the body 64 so long as they create sufficient turbulence in the fuel-air mixture to disrupt the concentration of fuel-air mixture to the outside curve 72 that would otherwise occur due to centrifugal force on the mixture as the mixture flows through the 180° bend portion 66. The ribs 68 and 70 may for example be about one-eighth of an inch high.

As shown in FIG. 8, the first rib 68 is located approximately one half way through the 180° bend portion, and the second rib 70 is located approximately three quarters of the way around the 180° bend portion. In general, the flow disrupters 68 and 70 are preferably located closer to the outlet 60 than to the inlet 56.

As seen in FIG. 6, the rectangular inlet 56 has a length 76 and a width 78. The circular outlet 60 has a diameter 80 which can be generally described as being greater than the width 78 and less than the length 76. In the example shown, the width 78 is 2.459 inches, the length 76 is 3.918 inches and the diameter 80 is 2.870 inches.

The transfer arm 54 includes a rectangular inlet flange 82 on the tubular body 64 adjacent the inlet 56 for connecting the transfer arm 54 to the blower outlet 30. The transfer arm 54 includes an annular outlet flange 84 on the tubular body 64 adjacent the circular outlet 60 for connecting the transfer arm 54 to the burner 20 and the heat exchanger 12. The annular outlet flange 84 actually bolts to the heat exchanger access door 40 so that the inlet end 26 of burner tube 20 is sandwiched therebetween.

As seen best in FIGS. 5, 7 and 8, the outlet flange 84 is longitudinally offset from the inlet flange 82 in a direction parallel to the inlet axis 58 and outlet axis 62 by an offset distance 86 so that the inlet 56 extends further away from the 180° bend portion 66 than does the outlet 60.

Figure 3:
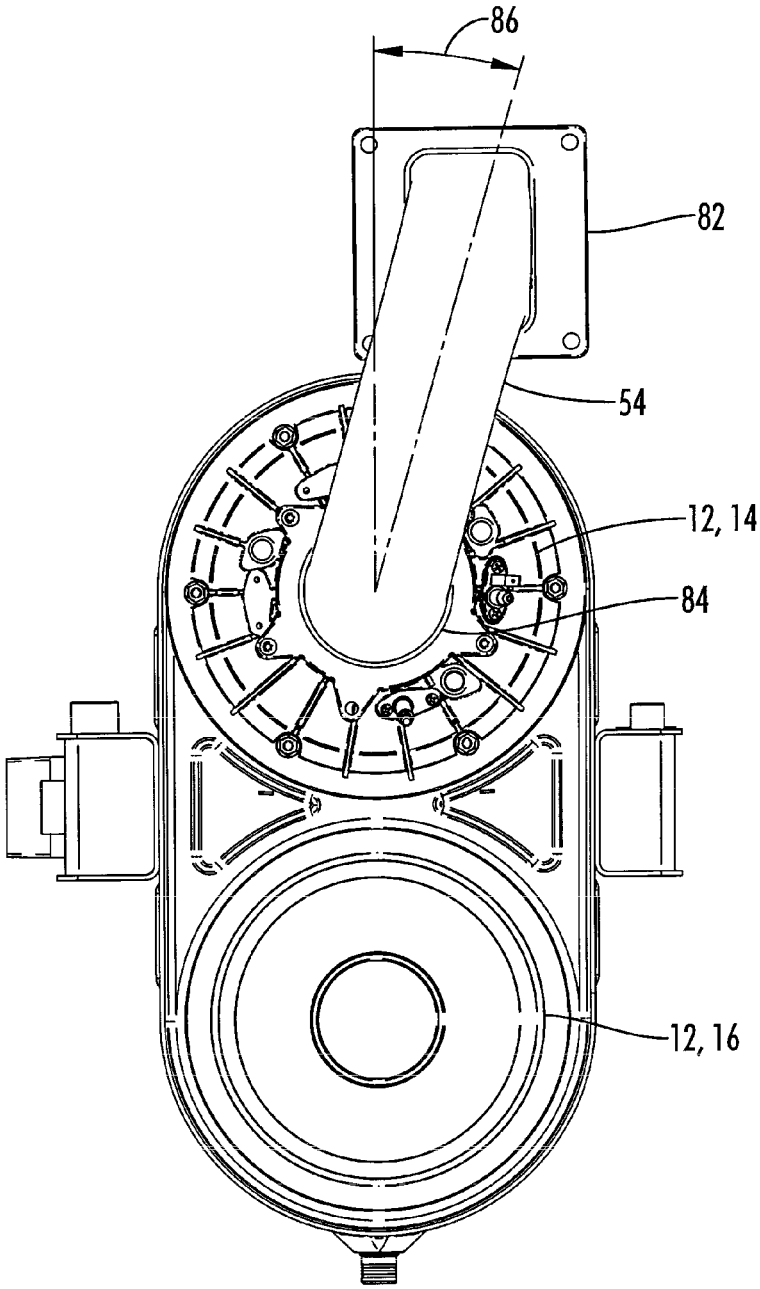
FIG. 3 is a front end elevation view of the water heater of FIG. 1.
Figure 4:
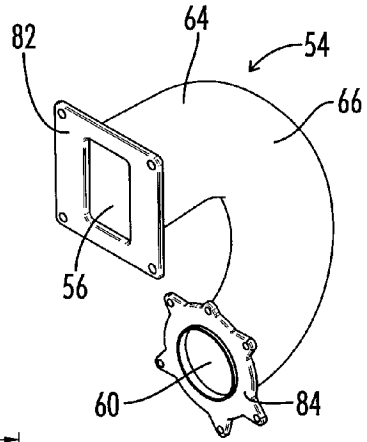
FIG. 4 is a perspective view of the fuel-air transfer arm.

As best seen in FIGS. 3 and 6, the length and width 76 and 78 of the rectangular inlet 56 are angularly offset by an offset angle 86 from an imaginary plane along line 8-8 of FIG. 6 defined between the inlet axis 58 and outlet axis 62, so as to reduce a vertical height of the blower 28 over the heat exchanger 12 of water heater 10 when the blower 28 and the remaining components of the water heater 10 are assembled with the transfer arm 54 as seen in FIG. 1. In the embodiment illustrated the angle 86 is approximately 16°. Reduction in the overall height of the assembled water heater 10 improves the compact packaging of the water heater 10 within its outer housing.

Thus, although there have been described particular embodiments of the present invention of a new and useful Air Transfer Arm For Boiler, it is not intended that such references be construed as limitations upon the scope of this invention except as set forth in the following claims.

What is claimed is:

1. A water heater apparatus comprising:

a horizontally oriented cylindrical heat exchanger having a central combustion chamber defined concentrically within the cylindrical heat exchanger;

an elongated burner tube extending axially in a first direction into the combustion chamber, the burner tube having a burner inlet;

a variable speed pre-mix blower located above the heat exchanger for providing a fuel-air mixture to the burner tube at variable flow rates, the blower having a blower outlet; and a fuel-air transfer arm connecting the blower outlet to the burner inlet, the transfer arm including a transfer arm inlet connected to the blower and a transfer arm outlet connected to the burner tube, a continuously curved 180° bend portion between the transfer arm inlet and the transfer arm outlet, and at least one inwardly extending internal flow disrupter located in the 180° bend portion, for improving fuel-air mixture distribution across the burner inlet; wherein the internal flow disrupter comprises an inwardly projecting rib extending peripherally around at least a portion of an inside cross-section of the transfer arm, the rib being located in an outside curve of the 180° bend portion of the transfer arm for disrupting a concentration of flowing fuel-air mixture to the outside curve that would otherwise occur due to centrifugal force on the mixture as the mixture flows through the 180° bend portion.

2. The apparatus of claim 1, wherein:

the blower outlet is rectangular;

the burner inlet is circular; and the transfer arm inlet is rectangular and the transfer arm outlet is circular, and the transfer arm has a cross-sectional shape that transitions from rectangular to circular.

3. The apparatus of claim 1, wherein the internal flow disrupter is located closer to the burner than to the blower.

4. The apparatus of claim 1, wherein the rib extends around the entire inside cross-section of the transfer arm.

5. The apparatus of claim 4, wherein the internal flow disrupter includes at least two such ribs.

6. The apparatus of claim 1, wherein the blower outlet is longitudinally offset in the first direction from the burner inlet.

7. The apparatus of claim 6, wherein the blower outlet is laterally offset from the burner inlet so that the transfer arm apparatus is oriented at an angular offset from vertical so as to reduce an overall height of the blower over the combustion chamber.

* * * * *